US005991969A

United States Patent [19]

Lee

[11] Patent Number: 5,991,969

[45] Date of Patent: Nov. 30, 1999

[54] NOISE ABSORBING DEVICE FOR VACUUM CLEANER

[75] Inventor: Nam-Ho Lee, Kunpo, Rep. of Korea

[73] Assignee: Daewoo Electronics Co., Ltd., Seoul, Rep. of Korea

[21] Appl. No.: 09/080,408

[22] Filed: May 18, 1998

[30] Foreign Application Priority Data

Jun. 30, 1997 [KR] Rep. of Korea ..... 97-29905
Oct. 27, 1997 [KR] Rep. of Korea ..... 97-55331

[51] Int. Cl.[6] ..... A47L 9/22

[52] U.S. Cl. ..... 15/326; 15/327.7; 96/382

[58] Field of Search ..... 15/326, 327.2, 15/327.7, 347; 55/DIG. 30; 96/382, 384, 385

[56] References Cited

FOREIGN PATENT DOCUMENTS

| | | | |
|---|---|---|---|
| 0 345 699 | 12/1989 | European Pat. Off. | 15/326 |
| 41 00 858 | 7/1992 | Germany | 15/326 |
| 52-35476 | 3/1977 | Japan | 15/326 |
| 4-096721 | 3/1992 | Japan | 15/326 |
| 4-187130 | 7/1992 | Japan | 15/326 |
| 4-319324 | 11/1992 | Japan | 15/326 |
| 5-003842 | 1/1993 | Japan | 15/326 |
| 5-176868 | 7/1993 | Japan | 15/326 |

*Primary Examiner*—William H. Beisner
*Attorney, Agent, or Firm*—Jacobson, Price, Holman & Stern, PLLC

[57] ABSTRACT

In a vacuum cleaner a suction motor is installed in a front casing. The front casing has a first main body with a first suction opening connected to the suction motor. An opposite side face of the first main body is opened. A lower chamber communicates with the first main body by a penetrating hole. An upper chamber is installed on an upper part of the first main body. The lower chamber and the upper chamber communicate with each other by a rear casing which covers the front casing. An air guider is installed inside the front casing. The air guider has a second opened side face, an opposite second closed side face closed with a closing plate, and a top penetrating hole formed through a top surface of the second main body. The closing plate closes the opened side face of the first main body. Thus, air sucked into the suction motor is exhausted to an inside of the air guider. The air is guided to an outside of the air guider via the top penetrating hole, and downwardly guided along the outer surface of the cylindrical body of the air guider, and then flows into the lower chamber through the penetrating hole. The air flows into the upper chamber through the air flow path formed by the rear casing, and is exhausted to the outside of vacuum cleaner through the filter receiving part.

10 Claims, 4 Drawing Sheets

NOISE ABSORBING DEVICE FOR VACUUM CLEANER

BACKGROUND OF THE INVENTION

1. Field of the Invention

The present invention relates to a noise absorbing device of a vacuum cleaner, and more particularly to a noise absorbing device of a vacuum cleaner of which efficiency for absorbing noise is increased due to an extended exhaust air flow path.

2. Description of the Prior Art

In the prior art, several types of noise absorbing devices for vacuum cleaners have been proposed and widely used.

For example, Japanese U.M. Publication No. Sho. 62-45631 (applied on Oct. 23, 1981 and published on Dec. 7, 1987) discloses a noise absorbing device of a vacuum cleaner which is shown in FIG. 1 of the accompanying drawings.

As shown in FIG. 1, the conventional vacuum cleaner comprises a suction motor 2 provided in a cleaner housing 1. In FIG. 1, the suction motor 2 is connected with a suction port 8. The air is exhausted to the rear portion of the suction motor 2 through the suction port 8. The exhaust port provided on the back of the housing 1 for exhausting the purified air to the outside is denoted by the numeral 3. The suction motor 2 for generating suction force communicates with the exhaust port 3 through both an air path 4 and an exhaust silencer 5. The exhaust silencer 5 defines an exhaust path 6 therein. In the above noise absorbing device, the exhaust path 6 of the exhaust silencer 5 is inclined upwardly from an air path 4 at an obtuse angle. With the inclined relationship between the exhaust path 6 and air path 4 of the housing 1, it is possible to suppress the turbulence noise caused by the exhaust air flow having already passed through the suction motor 2. In the above silencing device, the turbulence noise is partly absorbed and suppressed by a noise absorbing material 7.

However, the above noise absorbing device for a vacuum cleaner, while partly absorbing and suppressing the exhaust noise caused by exhaust air flow having passed through the suction motor 2, nevertheless has a problem that the exhaust air flow should pass through a relatively short path and be exhausted to the outside of the housing 1, so that it is impossible to achieve the desired noise absorbing and suppressing effect.

Moreover, the exhaust air passing through the suction motor 2 is exhausted not through a filter but directly through a chink of the assembled part of the housing 1 to the outside, which causes efficiency of the cleaning working to deteriorate.

SUMMARY OF THE INVENTION

Therefore, it is an object of the present invention to provide a noise absorbing device of a vacuum cleaner which has an extended exhaust air flow path and a compact structure.

It is another object of the present invention to provide a noise absorbing device of a vacuum cleaner in which efficiency of cleaning working is increased by a perfect sealing.

To achieve the above objects of the present invention, there is provided a noise absorbing device of a vacuum cleaner which comprises:

a suction motor having a front suction portion for sucking in dust and a rear exhaust portion for exhausting the sucked dust;

a front casing for receiving the suction motor, the front casing having a first main body provided with a first suction opening to suck dust into the front suction portion by operation of the suction motor and a first main body provided with a first opened side face opposite to the first suction opening, the front casing having a penetrating hole formed through a bottom surface of the first main body, the front casing having a lower chamber for communicating with the first main body by the penetrating hole, a side face of the lower chamber arranged with the first opened side face of the first main body being opened, the front casing having an upper chamber installed on an upper part of the first main body and provided with a filter receiving part formed on an upper part of the upper chamber, and a side face of the upper chamber arranged with the first opened side face of the first main body being opened;

an air guider for guiding exhaust air along an extended exhaust air flow path formed between an outer surface of the air guider and an inner surface of the front casing, the air guider having a second main body spaced away from the inner surface of the front casing inside the front casing, the air guider having a second opened side face and an opposite second closed side face closed with a closing plate, the air guider having a top penetrating hole formed through a top surface of the second main body to upwardly exhaust air sucked by the suction motor, the rear exhaust part of the suction motor being inserted through the second opened side face, and the closing plate closing the first opened side face of the first main body of the front casing; and a rear casing for covering the open side faces of the front casing, the upper chamber and lower chamber of the front casing communicating with each other by the rear casing, and thereby exhaust air from the suction motor proceeding to the upper chamber from the lower chamber.

A motor packing member is installed between the front casing and the suction motor to absorb noise and vibration generated during driving of the suction motor.

According to the noise absorbing device of the vacuum cleaner of the present invention, due to the absorbing noise material installed on the very long air flow path having the inner surface and the outer surface of the second main body of the air guider and the inner surface of the front casing, noise generated by the suction motor during cleaning operation of the vacuum cleaner is effectively suppressed and absorbed.

Furthermore, a linear recess part 29 of U-shaped cross section is formed on an outermost edge of the opened surfaces of the front casing 20 or the rear casing 30, and a linear sealing member 60 is inserted, so that sealing strength between the front casing and the rear casing can be strengthened.

A cross-section of a contact part between the opened side face of the first main body of the front casing and the closing plate of the air guider has a step shape, so that sealing strength between the opened side face of the front casing and the closing plate of the air guider can be strengthened.

According to the noise absorbing device of the vacuum cleaner of the present invention, since sealing strength of contact parts between respective members is largely strengthened, the air is prevented from leaking out through a crack in the contact part without secondary filtering by the filter member. Therefore, efficiency of the cleaning operation is increased. Moreover, since the air exhausted from the suction motor passes through all of the exhaust air flow path without leaking out, the suppressing and absorbing effect is increased.

Furthermore, according to the noise absorbing device of the vacuum cleaner of the present invention, since a specific structure of the exhaust air flow path is provided, it is possible to produce a compact and low noise vacuum cleaner.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Hereinafter, the preferred embodiments of this invention will be described in detail with reference to the accompanying drawings.

Figure 1:
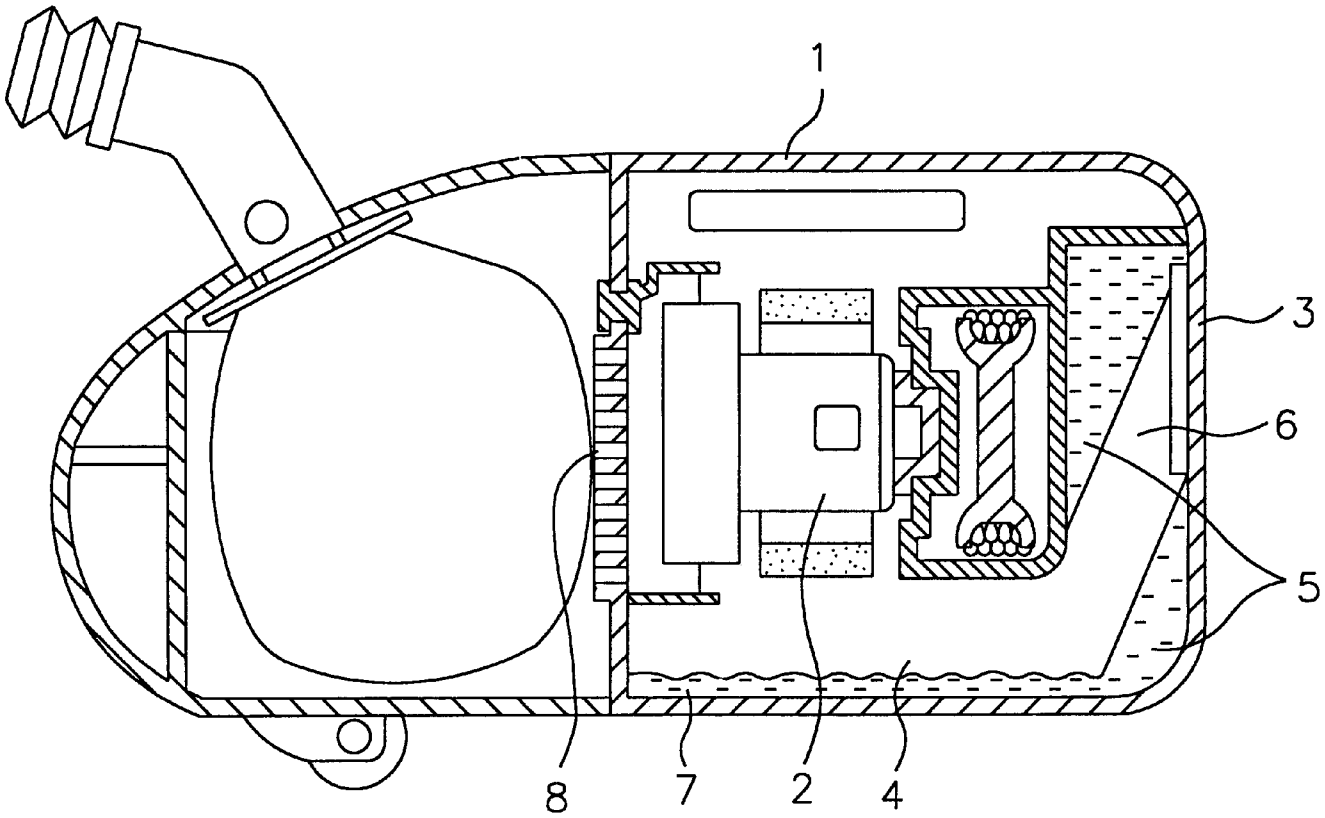
FIG. 1 PRIOR ART
FIG. 1 is a schematic cross-sectional view showing a conventional vacuum cleaner.
Figure 2:
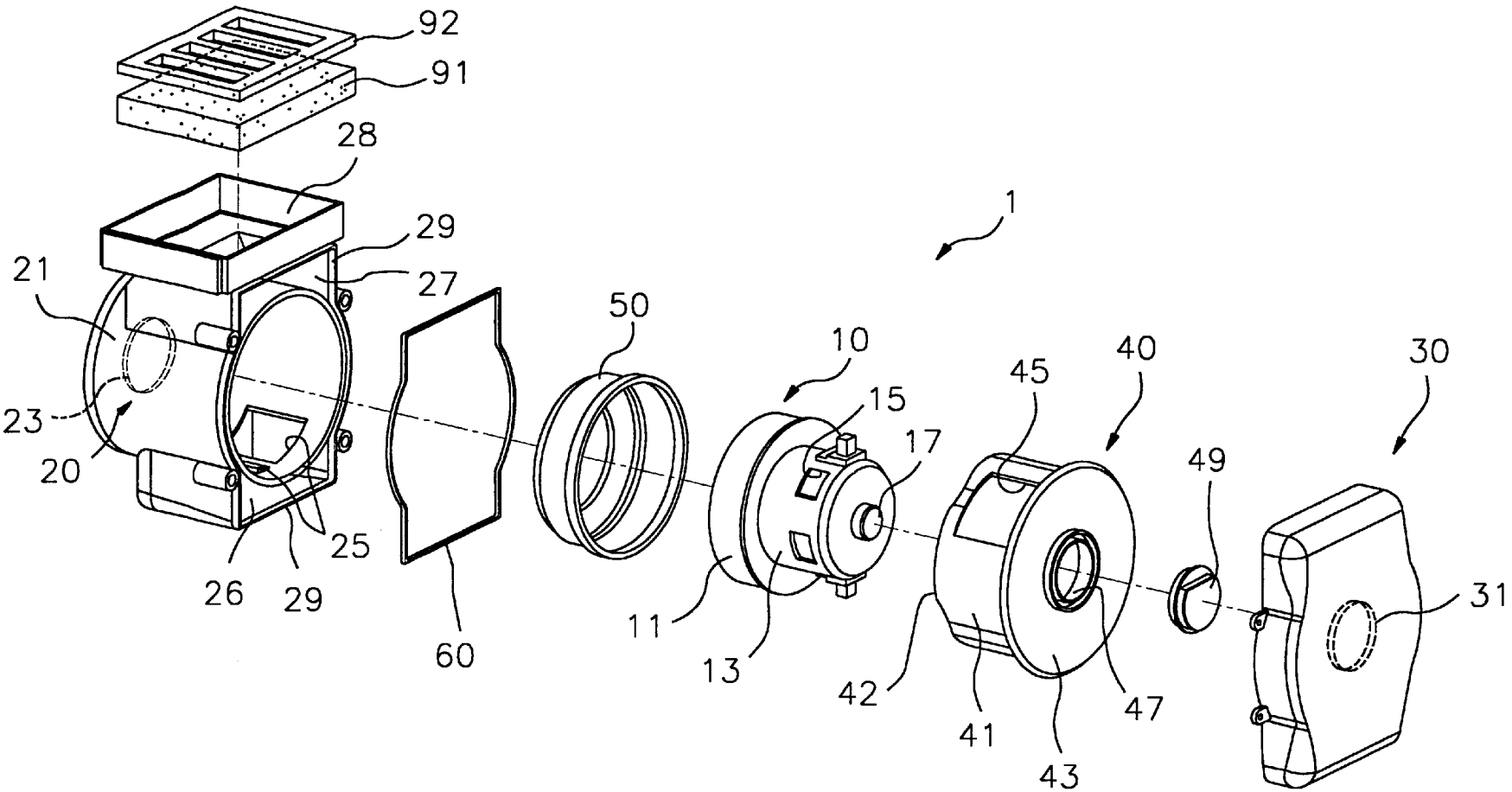
FIG. 2 is an exploded perspective view for showing a noise absorbing device of a vacuum cleaner of one embodiment of the present invention.
Figure 3:
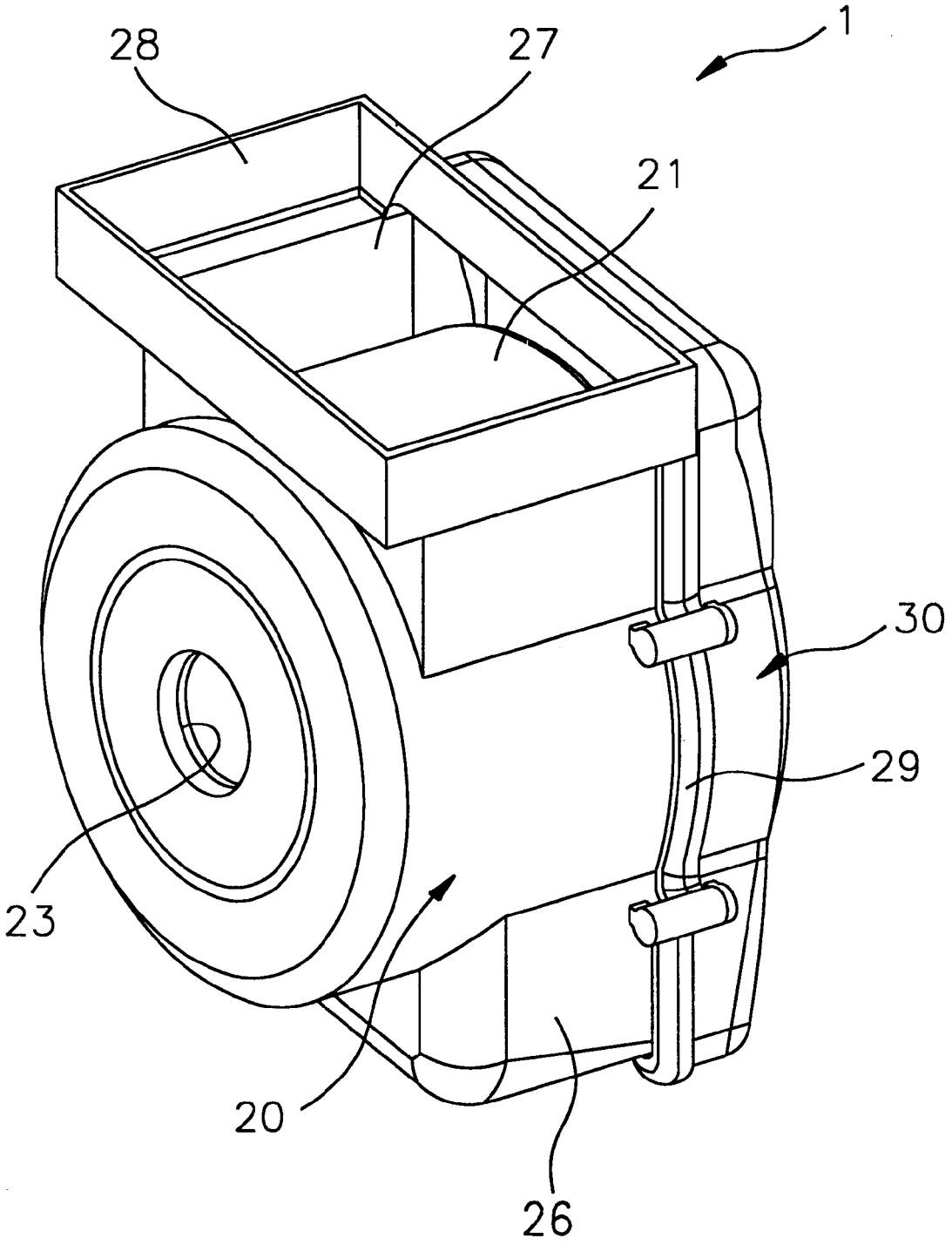
FIG. 3 is a perspective view for showing the noise absorbing device of the vacuum cleaner of FIG. 2.
Figure 4:
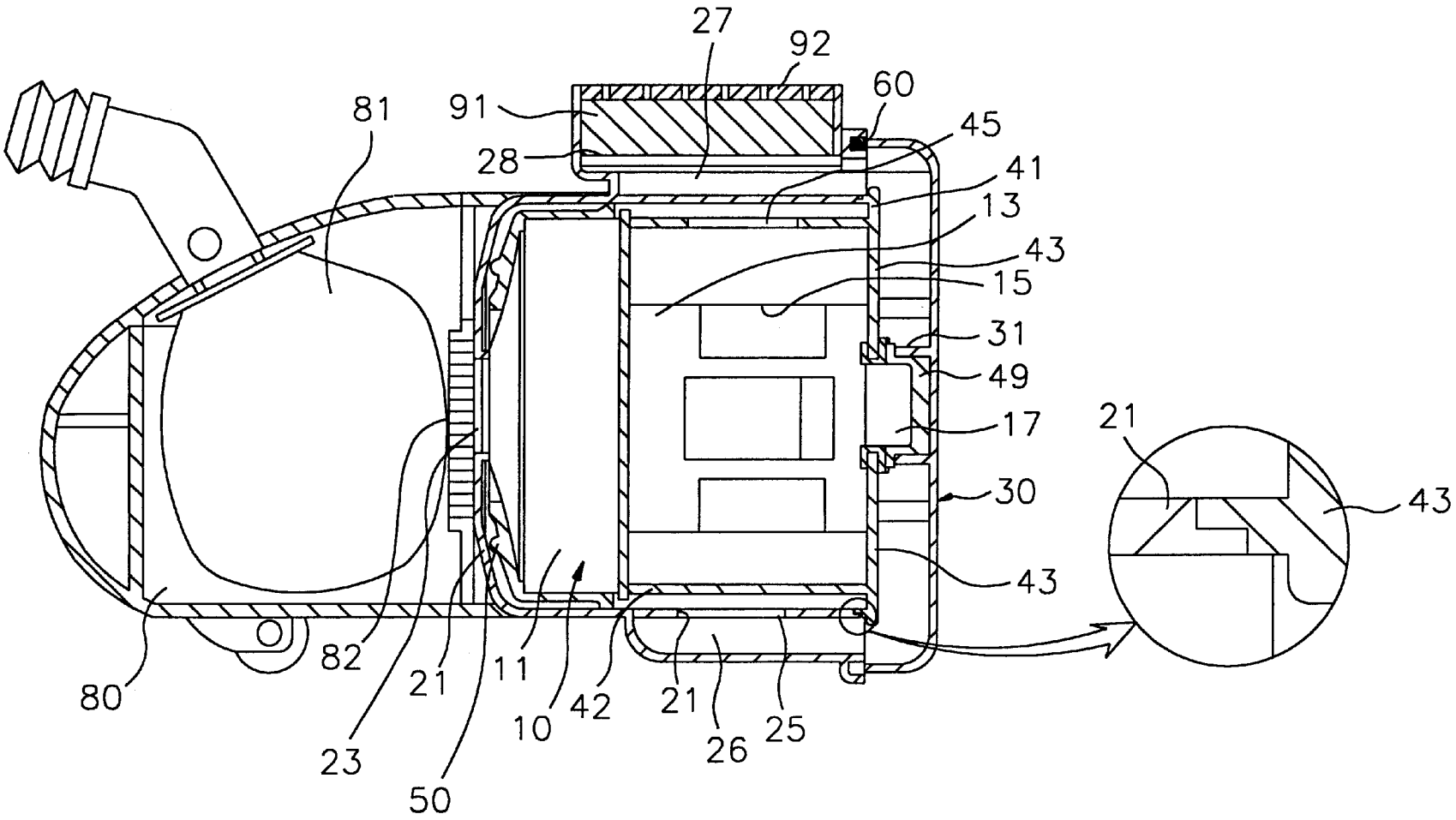
FIG. 4 is a schematic view showing the vacuum cleaner in which the noise absorbing device of FIG. 2 is mounted.

FIG. 2 is an exploded perspective view for showing a noise absorbing device of a vacuum cleaner of one embodiment of the present invention. FIG. 3 is a perspective view for showing the noise absorbing device of the vacuum cleaner of FIG. 2. FIG. 4 is a schematic view showing the vacuum cleaner in which the noise absorbing device of FIG. 2 is mounted.

Reference numeral 10 is a suction motor having a front suction portion 11 for sucking in dust and a rear exhaust portion 13 for exhausting the sucked dust. By driving the suction motor 10, air is sucked in through the front suction portion 11 and exhausted through penetrating holes 15 of the rear exhaust portion 13.

A front casing 20 has a first main body 21 of cylindrical shape for receiving the suction motor 10. The first main body 21 is provided with a first suction opening 23 to suck in dust into the front suction portion by operation of the suction motor, and with a first opened side face 22 opposite to the first suction opening 23. The first suction opening 23 of the front casing 20 makes contact with a suction port 82 of the vacuum cleaner. The front suction portion 11 of the suction motor 10 is installed inside the front casing 20 and makes contact with the first suction opening 23. A penetrating hole 25 is formed through a lower cylindrical surface of the first main body 21. A lower chamber 26 communicates with the first main body 21 by the penetrating hole 25. A side face of the lower chamber 26 arranged with the first opened side face of the first main body 21 is opened. An upper chamber 27 is installed on an upper part of the first main body 21. A side face of the upper chamber 27 arranged with the first opened side face of the first main body 21 is opened. A filter receiving part 28 is formed at an upper part of the upper chamber 27. The filter receiving part 28 has a filtering member 91 and grill 92 for seating the filtering member 91.

An air guider 40 is installed inside the front casing 20. The air guider 40 has a second cylindrical main body 41 spaced away from an inner face of the front casing 20. The air guider 40 has a second opened side face and an opposite second closed side face closed with a closing plate 43. A mounting hole is formed through a center portion of the closing plate 43 for mounting a motor-mounter 49. The rear exhaust portion 13 of the suction motor 10 is inserted through the second opened side face of the second main body 41. A projector 17 for mounting is inserted into the mounting hole 47 and fixed by the motor-mounter 49.

A length of the cylindrical main body 41 is so determined to correspond with that of the rear exhaust portion 13 of the suction motor 10 so that a circular end 42 of the opened face can be closely fixed to the suction motor 10. The circular end 42 is preferably formed of sealing material such as rubber.

The closing plate 43 closes the first opened side face 22 of the first main body 21 of the front casing 20. A cross-section of a contact part between the opened side face 22 of the first main body 21 of the front casing 20 and the closing plate 43 of the air guider 40 has a step shape, so that the contact part between the opened side face 22 of the front casing 20 and the closing plate 43 of the air guider 40 can be completely sealed.

A top penetrating hole 45 is formed through a top surface of the second main body 41.

Thus, air sucked by the suction motor 10 is upwardly guided and exhausted through the top penetrating hole 45 of the air guider 40.

A rear casing 30 has a cover shape for covering the open side faces of the front casing 20, and makes the upper chamber 27 and the lower chamber 26 communicate to each other, so that air exhausted from the suction motor 10 can pass through the lower chamber 26 and then proceed to the upper chamber 27 from the lower chamber 26 along the path made by rear casing 30.

In order to absorb and suppress noise during cleaning operation of the vacuum cleaner, noise absorbing material is installed on the air flow path having the inner surface and the outer surface of the second main body 41 of the air guider 40 and the inner surface of the front casing 20.

A motor packing member 50 is installed between the front casing 20 and the suction motor 10 to absorb noise and vibration of the motor 10 generated during driving the suction motor 10.

In order to strengthen sealing strength between the front casing 20 and the rear casing 30, a linear recess part 29 of U-shaped cross section is formed on an outermost edge of the opened faces of the front casing 20 or an edge of the rear casing 30, at which the front casing 20 and the rear casing 30 meet, and a linear sealing member 60 is inserted into the linear recess part 29.

To fix motor-mounter 49, a fixing part 31 is installed on the inside surface of the rear casing 30 at a corresponding position to the motor-mounter 49.

Hereinafter, an operation according to the foregoing embodiment will be described.

When the cleaning operation is practiced with the vacuum cleaner having the noise absorbing device as above-mentioned, air including dust at the place to be cleaned is forced to be sucked into a dust bag 81 of a dust collecting chamber 80 by the sucking force generated by driving the suction motor 10 in the noise absorbing device 1.

The sucked air first-filtered in the dust collecting chamber 80 passes in order through the suction port 82, the first suction opening 23, and the front suction portion 11 of the suction motor 10, and then is sucked into the suction motor 10. The air is exhausted into the inside of the cylindrical main body 41 of the air guider 40 via the penetrating holes 15.

Since the circular end 42 of the cylindrical main body 41 of the air guider 40 is closely fixed to the suction motor 10, the exhaust air is guided to the outside of the air guider 40 through the top penetrating hole 45 penetrating the upper cylindrical surface of the air guider 40.

Since the opened side face 22 of the first main body 21 of the front casing 20 and the closing plate 43 of the air guider 40 are completely sealed to each other, the guided air is downwardly guided along the outer surface of the cylindrical body 41 of the air guider 40.

The guided air flows into the lower chamber 26 through the penetrating hole 25 formed at the bottom surface of the first main body 21 of the front casing 20. The air passes through the air flow path formed by the rear casing 30, and then flows into the upper chamber 27.

The guided air passes through the filter receiving part 28, so that the air is secondarily purified by the filtering member 91.

In another embodiment, the length of the cylindrical main body 41 of the air guider 40 can be so determined to be shorter than that of the rear exhaust portion 13 of the suction motor 10. The top penetrating hole 45 penetrating the upper cylindrical surface of the second main body 41 of the air guider 40 may not be formed.

At this time, the sucked air first-filtered in the dust collecting chamber 80 is sucked into the suction motor 10 through the front suction portion 11 of the suction motor 10. The air is exhausted through the penetrating holes 15 of the rear exhaust portion 13. The exhausted air is guided to the outside of the air guider 40 through the aperture formed between the circular end 42 of the cylindrical main body 41 of the air guider 40 and the suction motor 10. The air guided to the outside of the air guider 40 is downwardly guided along the outer surface of the cylindrical body 41 of the air guider 40. The guided air flows into the lower chamber 26 through the penetrating hole 25 formed at the bottom surface of the first main body 21 of the front casing 20.

The air is guided into the upper chamber 27, and passes through the filter receiving part 28, so that the air is secondarily purified by the filtering member 91.

According to the embodiments of the present invention, due to the absorbing noise material installed on the very long air flow path having the inner surface and the outer surface of the second main body 41 of the air guider 40 and the inner surface of the front casing, noise generated by the suction motor 10 during cleaning operation of the vacuum cleaner is effectively suppressed and absorbed.

Furthermore, a linear recess part 29 having U-shaped cross section is formed on an outermost edge of the opened surfaces of the front casing 20 or the rear casing 30, and a linear sealing member 60 is inserted, so that sealing strength between the front casing and the rear casing can be strengthened.

A cross-section of a contact part between the opened side face 22 of the first main body 21 of the front casing 20 and the closing plate 43 of the air guider 40 has a step shape, so that sealing strength between the opened side face 22 of the front casing 20 and the closing plate 43 of the air guider 40 can be strengthened.

According to the noise absorbing device of the vacuum cleaner of the present invention, since sealing strength of contact parts between respective members are largely strengthened, the air is prevented from leaking out through a crack in the contact part without secondary filtering by the filter member 91. Therefore, efficiency of the cleaning operation is increased. Moreover, since the air exhausted from the suction motor passes through all of the exhaust air flow path without leaking out, the suppressing and absorbing effect is increased.

Furthermore, according to the noise absorbing device of the vacuum cleaner of the present invention, since a specific structure of the exhaust air flow path is provided, it is possible to produce a compactized and low noise vacuum cleaner.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A noise absorbing device of a vacuum cleaner comprising:

a suction motor having a front suction portion for sucking in dust and a rear exhaust portion for exhausting the sucked dust;

a front casing for receiving the suction motor, the front casing having a first main body provided with a first suction opening to suck in the dust into the front suction portion by operation of the suction motor and the first main body provided with a first opened side face opposite to the first suction opening, the front casing having a penetrating hole formed through a bottom surface of the first main body, the front casing having a lower chamber for communicating with the first main body by the penetrating hole, a side face of the lower chamber arranged with the first opened side face of the first main body being opened, the front casing having an upper chamber installed on an upper part of the first main body and provided with a filter receiving part formed on an upper part of the upper chamber, and a side face of the upper chamber arranged with the first opened side face of the first main body being opened;

an air guider for guiding exhaust air along an extended exhaust air flow path formed between an outer surface of the air guider and an inner surface of the front casing, the air guider having a second main body spaced away from the inner surface of the front casing inside the front casing, the air guider having a second opened side face and an opposite second closed side face closed with a closing plate, the air guider having a top penetrating hole formed through a top surface of the second main body to upwardly exhaust air sucked by the suction motor, the rear exhaust part of the suction motor being inserted through the second opened side face, the closing plate closing the first opened side face of the first main body of the front casing; and a rear casing for covering the open side faces of the front casing, the upper chamber and lower chamber of the front casing communicating with each other by the rear casing, and thereby exhaust air from the suction motor proceeding to the upper chamber from the lower chamber.

2. A noise absorbing device of a vacuum cleaner as claimed in claim 1, wherein a noise absorbing material is installed on the air flow path having the inner surface and the outer surface of the second main body of the air guider and the inner surface of the front casing in order to absorb and suppress noise during cleaning operation of the vacuum cleaner.

3. A noise absorbing device of a vacuum cleaner as claimed in claim 1, wherein a linear recess part of U-shaped cross section is formed on an outermost edge of the opened faces of the front casing or an edge of the rear casing, at which the front casing and the rear casing meet, and a linear sealing member is inserted into the linear recess part in order to strengthen sealing strength between the front casing and the rear casing.

4. A noise absorbing device of a vacuum cleaner as claimed in claim 1, wherein the closing plate closes the first opened side face of the first main body of the front casing.

5. A noise absorbing device of a vacuum cleaner as claimed in claim 4, wherein a cross-section of a contact part between the opened side face of the first main body of the front casing and the closing plate of the air guider has a step shape, so that the contact part between the opened side face of the front casing and the closing plate of the air guider can be completely sealed.

6. A noise absorbing device of a vacuum cleaner as claimed in claim 1, wherein the contact part between the opened side face of the first main body of the front casing and the closing plate of the air guider is formed of sealing material such as rubber.

7. A noise absorbing device of a vacuum cleaner as claimed in claim 1, wherein a length of the second main body of the air guider is so determined to correspond with that of the rear exhaust portion of the suction motor so that a circular end of the opened face of the second main body is closely fixed to the suction motor.

8. A noise absorbing device of a vacuum cleaner as claimed in claim 7, wherein the circular end of the air guider is formed of sealing material such as rubber.

9. A noise absorbing device of a vacuum cleaner as claimed in claim 1, wherein a length of the second main body of the air guider is so determined to be shorter than that of the rear exhaust portion of the suction motor, so that the exhausted air from the suction motor is guided to the outside of the air guider through the aperture formed between an end of the second main body of the air guider and the suction motor.

10. A noise absorbing device of a vacuum cleaner as claimed in claim 1, wherein a motor packing member is installed between the front casing and the suction motor to absorb noise and vibration of the motor generated during driving of the suction motor.

* * * * *